US007007737B2

(12) United States Patent
Alexin

(10) Patent No.: US 7,007,737 B2
(45) Date of Patent: Mar. 7, 2006

(54) SLAB HANDLING APPARATUS

(75) Inventor: Barry J. Alexin, Monroe, MI (US)

(73) Assignee: Edw. C. Levy Co., Dearborn, MI (US)

( * ) Notice: Subject to any disclaimer, the term of this patent is extended or adjusted under 35 U.S.C. 154(b) by 0 days.

(21) Appl. No.: 10/950,705

(22) Filed: Sep. 27, 2004

(65) Prior Publication Data

US 2005/0067133 A1 Mar. 31, 2005

Related U.S. Application Data

(60) Provisional application No. 60/507,429, filed on Sep. 30, 2003.

(51) Int. Cl.
*B22D 11/12* (2006.01)

(52) U.S. Cl. ..... 164/263; 164/448

(58) Field of Classification Search ..... 164/263, 164/460, 448, 442

See application file for complete search history.

(56) References Cited

U.S. PATENT DOCUMENTS

| | | | | |
|---|---|---|---|---|
| 519,071 | A | | 5/1894 | Philipps |
| 2,334,250 | A | | 11/1943 | Cassens et al. ..... 266/23 |
| 2,672,529 | A | | 3/1954 | Villard, Jr. ..... 179/171 |
| 2,684,434 | A | | 7/1954 | Burey ..... 240/6.4 |
| 2,746,686 | A | | 5/1956 | Loveland et al. ..... 236/94 |
| 3,862,749 | A | | 1/1975 | Fieser et al. ..... 148/9.5 |
| 4,139,180 | A | | 2/1979 | Itani et al. ..... 266/69 |
| 4,201,371 | A | | 5/1980 | Pillon ..... 266/50 |
| 4,297,151 | A | | 10/1981 | Hoffken et al. ..... 148/9 R |
| 4,329,187 | A | | 5/1982 | Ushioda et al. ..... 148/9 R |
| 4,379,002 | A | | 4/1983 | Saito et al. ..... 148/9 R |
| 4,389,261 | A | | 6/1983 | Donze et al. ..... 148/9 R |
| 4,602,967 | A | | 7/1986 | Komma et al. ..... 148/9 R |
| 4,809,956 | A | | 3/1989 | Donze ..... 266/48 |
| 4,854,371 | A | * | 8/1989 | Katahira et al. ..... 164/431 |
| 4,923,527 | A | | 5/1990 | Ludwigson ..... 148/9 R |
| 5,102,473 | A | | 4/1992 | Grohmann ..... 148/9 R |
| 5,196,071 | A | | 3/1993 | Voye, Jr. ..... 148/194 |
| 5,256,212 | A | | 10/1993 | Magnuson ..... 148/194 |
| 5,597,030 | A | | 1/1997 | Lotz et al. ..... 164/263 |
| 5,626,181 | A | | 5/1997 | Lotz et al. ..... 164/263 |
| 5,765,271 | A | | 6/1998 | Lotz et al. ..... 29/33 |
| 5,876,162 | A | * | 3/1999 | Mancuso et al. ..... 409/300 |
| 6,060,679 | A | | 5/2000 | Ludwigson et al. ... 219/121.44 |

(Continued)

FOREIGN PATENT DOCUMENTS

CA 2 383 317 10/2002

(Continued)

*Primary Examiner*—Kevin Kerns
*Assistant Examiner*—I.-H. Lin
(74) *Attorney, Agent, or Firm*—Young & Basile, P.C.

(57) ABSTRACT

A slab handling apparatus comprising a foundation structure, a plurality of longitudinally spaced buffer members positioned on the foundation structure, and a plurality of longitudinally spaced roller assemblies connected to the respective buffer members with a lost motion connection. The lost motion connections allow relative movement between the buffer members and the roller assemblies between a slab loading position in which the buffer members are supported on the foundation structure with upper edges thereof above the roller assemblies, whereby to allow the loading of a slab onto the upper edges without damage to the roller assemblies, and a slab slitting position in which the roller assemblies are above the upper edges of the buffer members, whereby to allow the roller assemblies to rollably support the slab to facilitate selective longitudinal adjustment of the slab to accommodate the slab slitting operation.

21 Claims, 8 Drawing Sheets

U.S. PATENT DOCUMENTS

| | | | | |
|---|---|---|---|---|
| 6,165,410 | A | 12/2000 | Crees et al. | 266/49 |
| 6,170,139 | B1 | 1/2001 | Lotz | 29/33 |
| 6,261,512 | B1 | 7/2001 | Donze et al. | 266/48 |
| 6,334,906 | B1 | 1/2002 | Donze et al. | 148/203 |
| 6,534,739 | B1 | 3/2003 | Donze et al. | 219/121.39 |
| 6,712,911 | B1 * | 3/2004 | Donze et al. | 148/196 |
| 2002/0158375 | A1 | 10/2002 | Donze et al. | 266/58 |
| 2003/0037841 | A1 | 2/2003 | Bissonnette | 148/196 |

FOREIGN PATENT DOCUMENTS

| | | | |
|---|---|---|---|
| DE | 3742175 | C1 | 1/1989 |
| EP | 1252960 | A1 | 10/2002 |
| EP | 1413379 | A1 | 4/2004 |
| EP | 1413380 | A1 | 4/2004 |
| FR | 2 308 458 | | 11/1976 |
| FR | 2 635 284 | | 8/1988 |
| FR | 2 672 529 | | 2/1991 |
| FR | 2 684 434 | | 12/1991 |
| FR | 2 695 051 | | 8/1992 |
| FR | 2 746 686 | | 3/1996 |
| WO | WO94/16270 | | 7/1994 |
| WO | WO95/10734 | | 4/1995 |
| WO | WO96/18071 | | 6/1996 |
| WO | WO96/26806 | | 9/1996 |
| WO | WO98/43772 | | 10/1998 |
| WO | WO01/08842 | A1 | 2/2001 |
| WO | WO01/28727 | A1 | 4/2001 |

* cited by examiner

SLAB HANDLING APPARATUS

RELATED APPLICATIONS

This application claims the priority of U.S. Provisional Patent Application No. 60/507,429, filed on Sep. 30, 2003.

BACKGROUND OF THE INVENTION

This invention relates to slab slitting apparatus and more particularly to an apparatus for facilitating the handling of heavy steel slabs during a slab slitting operation.

Slabs emanating from a continuous casting mill are typically cut into slabs which are thereafter selectively slit to produce the desired final slab division.

One prior art slab slitting procedure utilizes a slitting apparatus including a bed of rollers and a plurality of oxy torches movable selectively relative to the roller bed. A slab to be slit is loaded onto the roller bed whereafter the slab and torches are relatively adjusted to position the torches at desired predetermined locations for the slitting operation. Whereas this procedure is generally satisfactory, there is a problem in that the slabs, which can be extremely heavy, may inflict major damage to the rollers as the slabs are loaded onto the rollers, necessitating extensive equipment downtime and expensive repairs.

SUMMARY OF THE INVENTION

This invention is directed to an improved slab handling apparatus and procedure.

More specifically, this invention is directed to a slab handling apparatus in which any equipment damage and consequent downtime and repair are minimized.

The slab handling apparatus of the invention includes a foundation structure; a plurality of longitudinally spaced buffer members positioned on the foundation structure; and a plurality of longitudinally spaced roller assemblies connected to the buffer members with a lost motion connection allowing relative movement between the buffer members and the roller assemblies between a slab loading position in which the buffer members are supported on the foundation structure with upper edges thereof above the roller assemblies and a slab slitting position in which the roller assemblies are above the upper edges of the buffer members. With this arrangement a slab may be loaded onto the upper edges of the buffer members without damage to the roller assemblies whereafter the roller assemblies and buffer members may be relatively moved by virtue of their lost motion connection to the slab slitting position where the roller assemblies support the slab to facilitate selective longitudinal adjustment of the slab to accommodate the slab slitting operation.

According to a further feature of the invention, each lost motion connection comprises a vertical slot receiving a pin, the pin moving vertically in the slot as the buffer member moves relative to the roller assembly between the loading and slitting positions. In the disclosed embodiment of the invention, the pins are carried by the roller assemblies and the slots are provided in the buffer members.

According to a further feature of the invention, the apparatus further includes a table defining a window and mounted for pivotal movement between a generally horizontal slab loading position in which the slab window overlies the foundation structure and an upwardly tilted, slab slitting position; the roller assemblies are mounted in longitudinally spaced relation on the table and the buffer members are supported in longitudinally spaced relation on the table by the lost motion connections between the roller assemblies and the buffer member; and with the table in the horizontal slab loading position, the buffer members are positioned in the table window and are supported on the foundation structure.

According to a further feature of the invention, the table includes a pair of parallel longitudinally extending guide rails; and each roller assembly includes a pair of laterally spaced guide blocks slidably guided on the respective guide rails, a beam structure extending laterally between the guide blocks, and a roller structure extending laterally between the guide blocks in overlying relation to the beam structure and journaled at opposite ends thereof on the respective guide blocks.

According to a further feature of the invention, each buffer member comprises an upstanding plate supported on the foundation structure with the apparatus in the slab loading position and each lost motion connection comprises a plurality of laterally spaced pins projecting from a beam structure of a roller assembly and received in a respective plurality of vertical slots provided in a buffer member plate.

According to further feature of the invention, each buffer member comprises forward and rearward longitudinally spaced and coupled upstanding plates flanking a respective roller assembly and each lost motion connection comprises a plurality of laterally spaced pins projecting forwardly and rearwardly from the beam structure of the respective roller assembly and received in a respective plurality of vertical slots in the forward and rearward plates of the buffer member.

According to further feature of the invention, each roller structure comprises a pair of longitudinally spaced rollers journaled at opposite ends on the guide blocks and each roller assembly further includes an upwardly directed torch position between the longitudinally spaced rollers and means operative to move the torch laterally between the rollers to achieve the slitting operation.

According to further feature of the invention, the beam structure of each roller assembly comprises a pair of laterally extending and longitudinally spaced beams and each torch extends upwardly between a pair of beams and between a pair of rollers of the respective roller assembly.

According to further feature of the invention, the apparatus further includes a deburring device positioned in opposition to each torch and movable laterally with the torch to achieve the slitting operation.

According to further feature of the invention, the apparatus further includes a gantry mounted on the table and including a central bar portion extending longitudinally on the table, and the deburring devices are slidably mounted on the gantry central bar portion in longitudinally spaced relation.

According to further feature of the invention, the apparatus further includes means for moving the gantry laterally relative to the table whereby to allow the deburring devices to be moved to a location clear of the rollers to allow the loading of a slab onto the rollers and thereafter moved laterally in synchronization with the associated torches to accomplish the slitting operations.

According to further feature of the invention, the apparatus further includes means for raising and lowering the gantry relative to the table.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
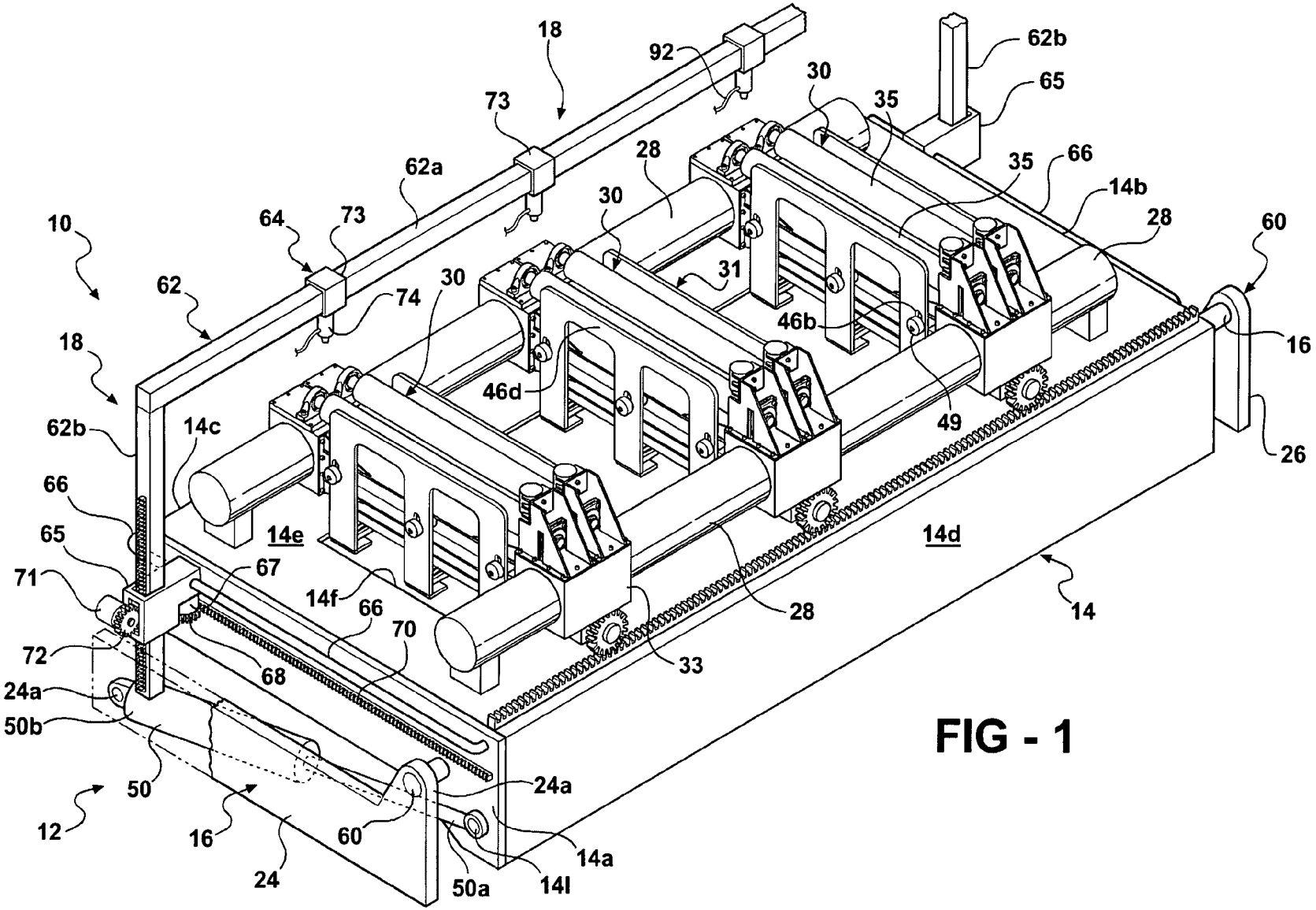
FIG. 1 is a perspective view of a slab handling apparatus according to the invention.

The invention slab handling apparatus 10, broadly considered, includes a base assembly 12, a table assembly 14, a pivot assembly 16, a deburring assembly 18, torches 20, and a foundation 22.

Base assembly 12 is shown schematically and includes spaced base members 24 and 26 adapted to be fixedly secured to a support structure or floor.

Table assembly 14 includes end plates 14*a* and 14*b*; side plates 14*c* and 14*d*; a top plate 14*e* defining a rectangular window 14*f*, guide rails 28 spaced above top plate 14*e* and running longitudinally along opposite sides of the table assembly proximate side plates 14*c* and 14*d*, respectively; a plurality of roller assemblies 30 positioned slidably on guide rails 28; and a plurality of buffer assemblies 31.

Each roller assembly 30 includes guide blocks 32 and 33 slidably mounted on respective guide rails 28; a beam structure 34 extending between the guide blocks; a pair of longitudinally spaced laterally extending rollers 35 journaled at their opposite ends on guide blocks 32 and 33; and a pair of vertical cushions 36 mounted on brackets 37 carried by guide block 33.

Beam structure 34 includes a pair of I beams 38 and 39 extending laterally between the guide blocks and spaced longitudinally to define a vertical channel or space 40 therebetween. A plurality of pins 41 extend rearwardly from the web 38*a* of rear I beam 38 and a plurality of pins 41 extend forwardly from the web 39*a* of front I beam 39.

Each roller assembly is selectively movable along guide rails 28 by electric motors 42 mounted on the underface of guide blocks 32 and 33 and including pinions 42*a* drivingly engaging longitudinally extending racks 43 provided on top plate 14*e* on opposite sides of the table.

Each buffer assembly 31 has "U" configuration in cross-section and includes front and rear plate members 46 and cross members 48. Each plate member 46 has an "E" configuration and the lower ends of each bar 46*a* of the "E" are connected by a respective cross member 48. Each bar 46*a* of the "E" of each plate member includes a vertical slot 46*b* receiving a pin 41 carried by beam structure 34 whereby to provide a lost motion connection between the buffer assembly and the roller assembly. Specifically, the pins 41 extending rearwardly from the web 38*a* of the rear beam 38 are received in the slots 46*b* defined by the rear plate member 46 and the pins 41 extending forwardly from the web 39*a* of the front plate member 39 are received in the slots 46*b* defined by the front plate member.

Pivot assembly 16 includes a pair of hydraulic rams 50 proximate each base member 24 and 26 between the respective base member and a table end plate 14*a*, 14*b*, and a pair of links 51, 52 proximate each end of the table assembly. The piston rod 50*a* of each ram 50 is pivotally connected to a pivot pin 14*i* carried by a respective end plate 14*a*, 14*b* and the other end 50*b* of the ram is pivotally secured to a pin 24*a*, 26*a* carried by a respective base member 24, 26. Each link 51 is pivotally secured at its lower end to a respective base member 24, 26; each link 52 is pivotally secured at its upper end to a respective end plate 14*a*, 14*b*; and the inboard ends of the links are pivotally secured at 53.

Table assembly 14 is pivotally secured to tower portions 24*a*, 26*a* of the base members 24, 26 by pivot pins 60 carried by end plates 14*a*, 14*b* and spaced from the pivot axes of the pins 14*i*. The parameters of the various aspects of the table assembly are chosen such that contracting movement of the rams 50 has the effect of pivoting the table assembly upwardly about the axes of pins 60 with the extent of upward movement being determined and delimited by run out of the rams and/or by ultimate alignment of links 51 and 52. For example, the parameters may be chosen such that the table is pivoted upwardly in response to the contraction of the rams to a position in which the upper face of the table lies in a primary plane at an angle $\alpha$ of between 10° and 20° from the vertical plane.

Deburring assembly 18 includes a gantry assembly 62 and a plurality of deburring devices 64. Gantry assembly 62 has a "U" configuration including a central horizontal bar portion 62*a* and vertical end bar portions 62*b*. Each vertical end bar portion 62*b* is slidably received in a sleeve structure 65 which is slidably mounted on a guide rail 66 mounted on a respective end plate 14*a*, 14*b*. An electric motor 67 carried by each sleeve structure includes a pinion 68 engaging a rack 70 mounted on a respective end plate 14*a*, 14*b* whereby to move the sleeve 64 and thereby the gantry along the guide rails 66 in response to actuation of motors 67. A further electric motor 71 carried by each sleeve structure 65 includes a pinion 72 engaging a rack on the respective end bar portion 62*b* whereby to raise and lower the gantry relative to the sleeve structures 65.

Each deburring device 64 includes a sleeve bracket 73 slidably mounted on the horizontal portion 62*a* of the gantry and a deburring device 74 carried by the sleeve bracket and positioned between the rollers 35 of a respective roller assembly 30.

A torch 20 is carried by each roller assembly 30 with the torch positioned between the rollers 35 and between I beams 38 and 39. Torch 20 is carried by a torch bracket 76 which is in turn secured to a ball screw member 78. Ball screw member 78 is driven in known manner by a screw shaft 80 driven by an electric motor 82 secured to the underface of guide block 32. The free end of screw shaft 80 is journaled in a bearing 84 positioned on the underface of guide block 33 and ball screw member 78 is mounted on and guides along a downward extension 38*b* of the web 38*a* of beam 38.

Foundation 22 is positioned in general underlying conformity with window 14*f* so that, with the table in its horizontal or rest position, base members 46*c* of the buffer structures 36 may rest on the upper face 22*a* of the foundation slab with the various parameters chosen such that, with the table at rest and the base members 46*c* positioned on the upper face 22*a* of the foundation member, the pins 41 are in the lower ends of the respective slots 46*b*.

OPERATION

Figure 2:
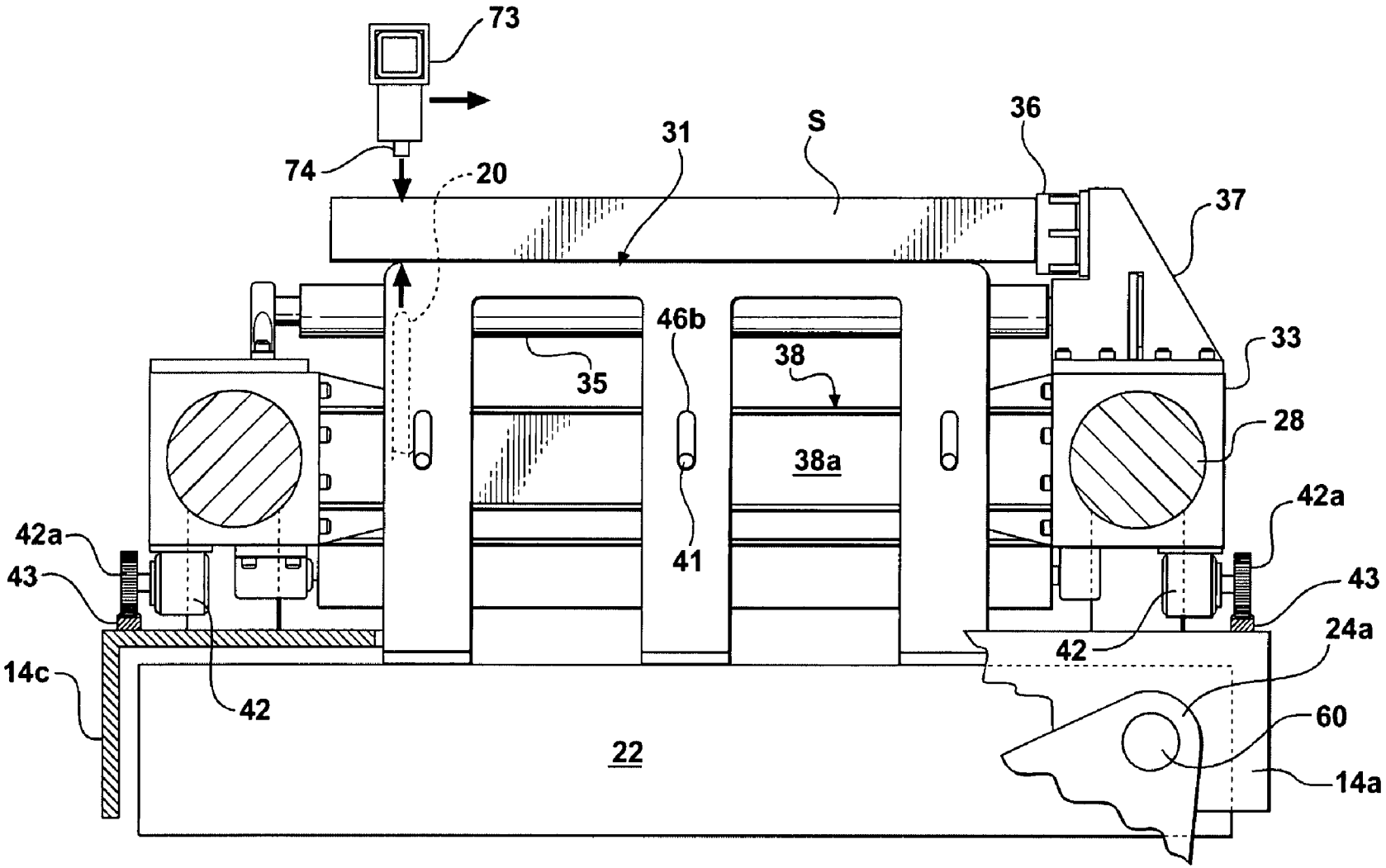
FIG. 2 is a somewhat schematic, cross-sectional view of the apparatus of FIG. 1.
Figure 3:
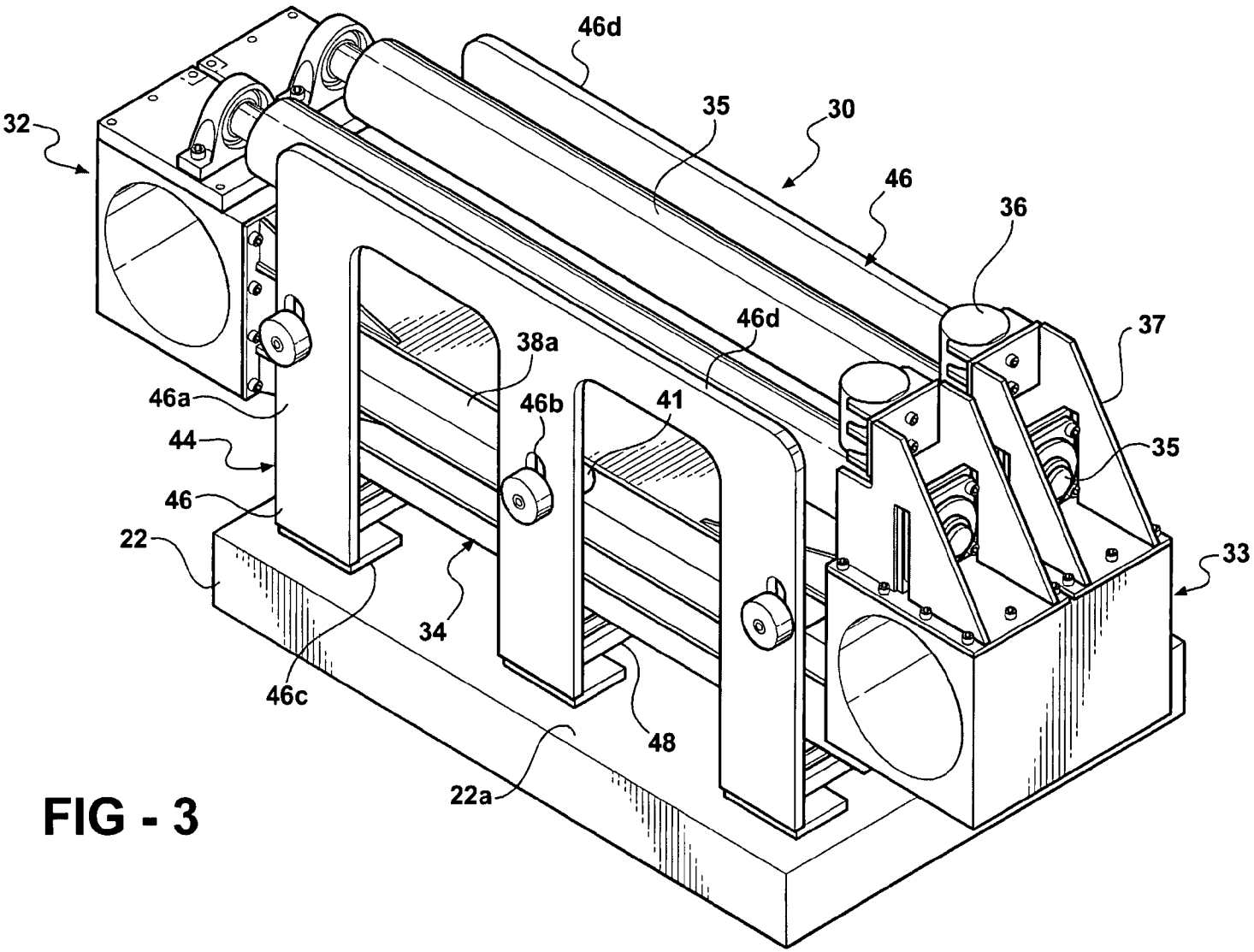
FIG. 3 is a perspective view of a roller and buffer assembly utilized in the apparatus of FIG. 1.
Figure 4:
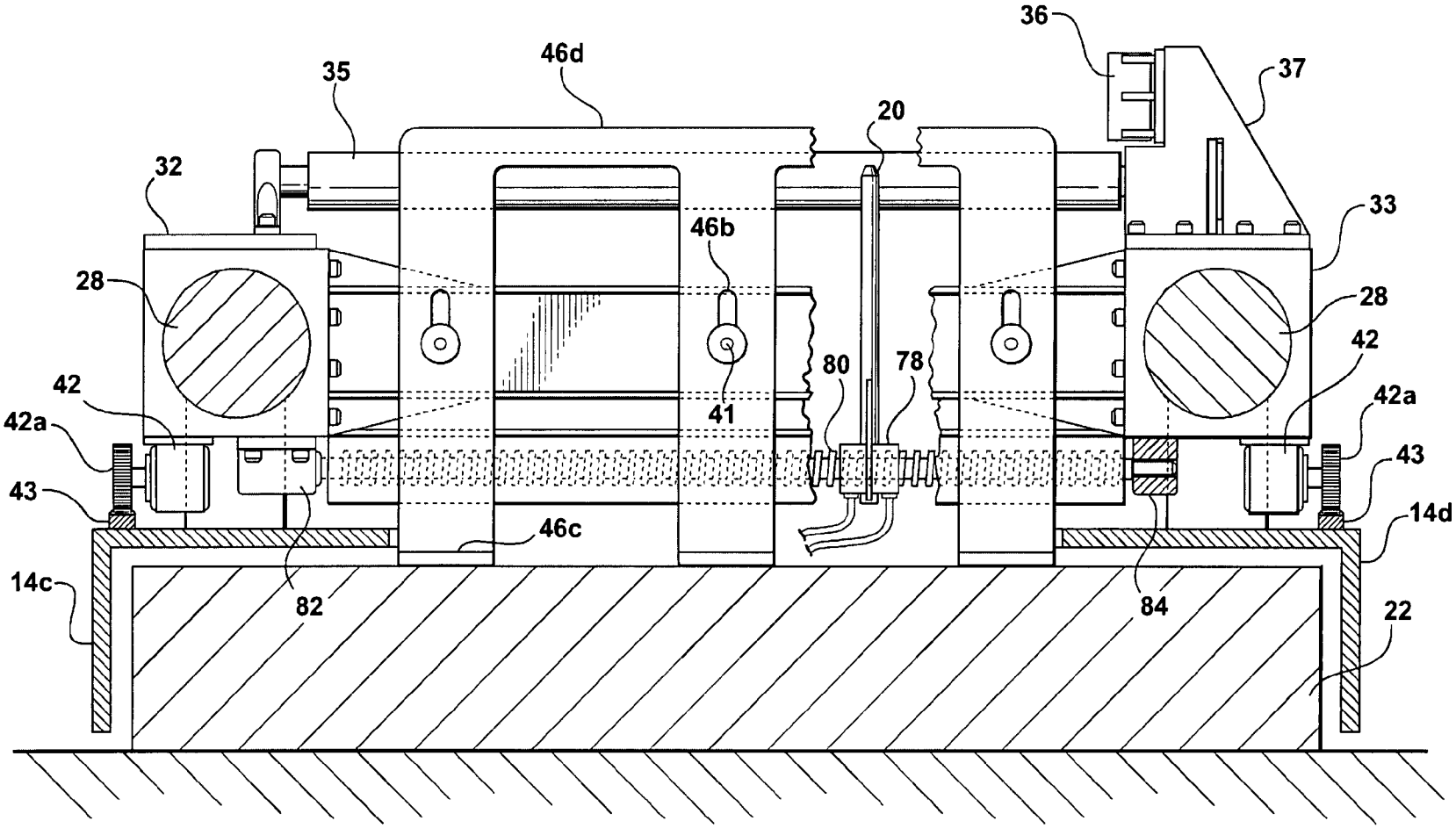
FIG. 4 is an elevational view of the roller and buffer assembly.
Figure 5:
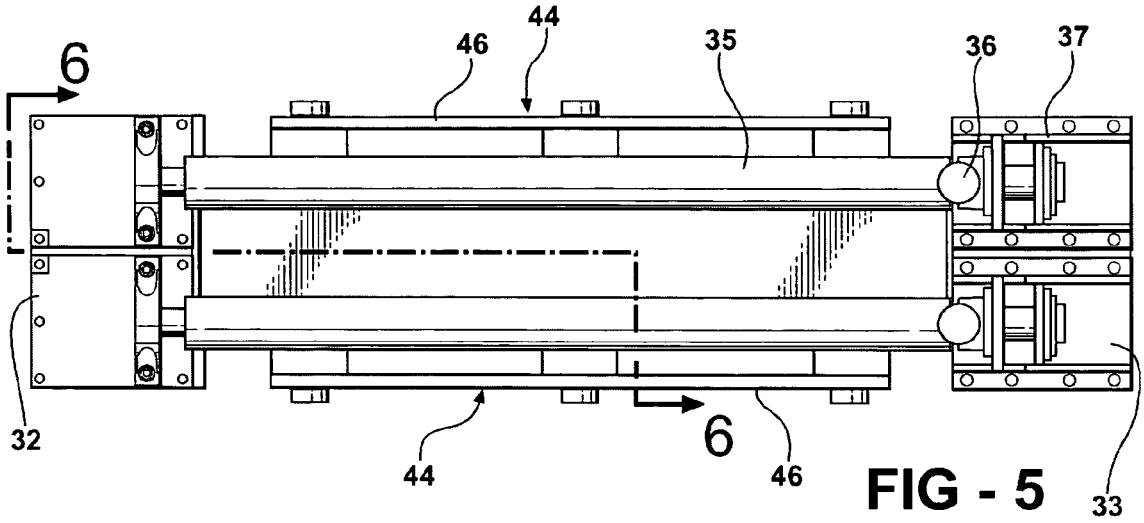
FIG. 5 is a plan view of the roller and buffer assembly.
Figure 6:
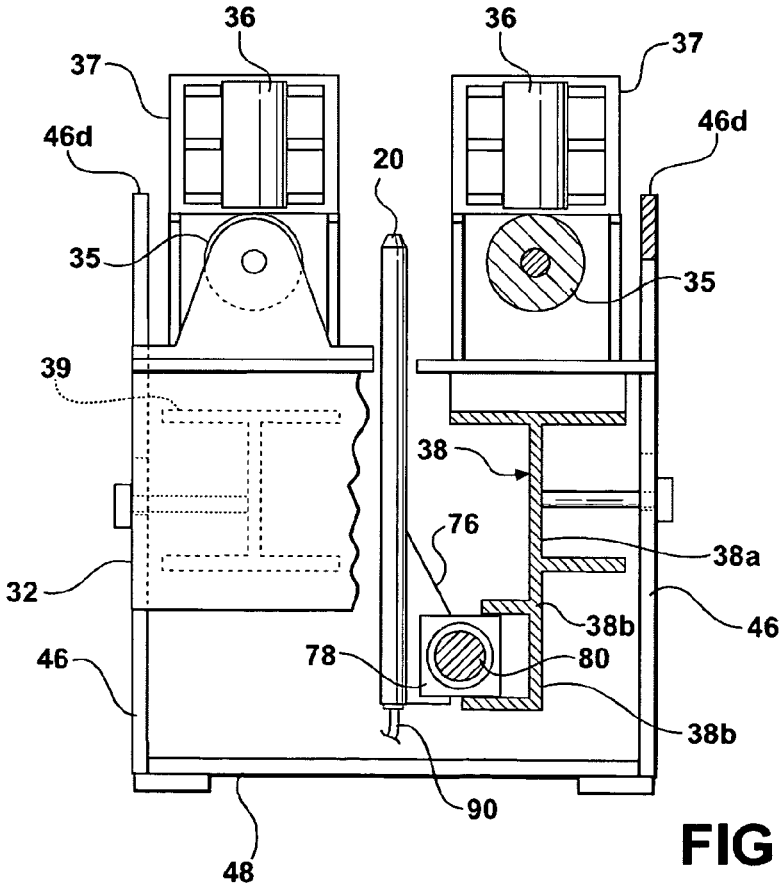
FIG. 6 is a cross sectional view taken on line 6—6 of FIG. 5.
Figure 7:
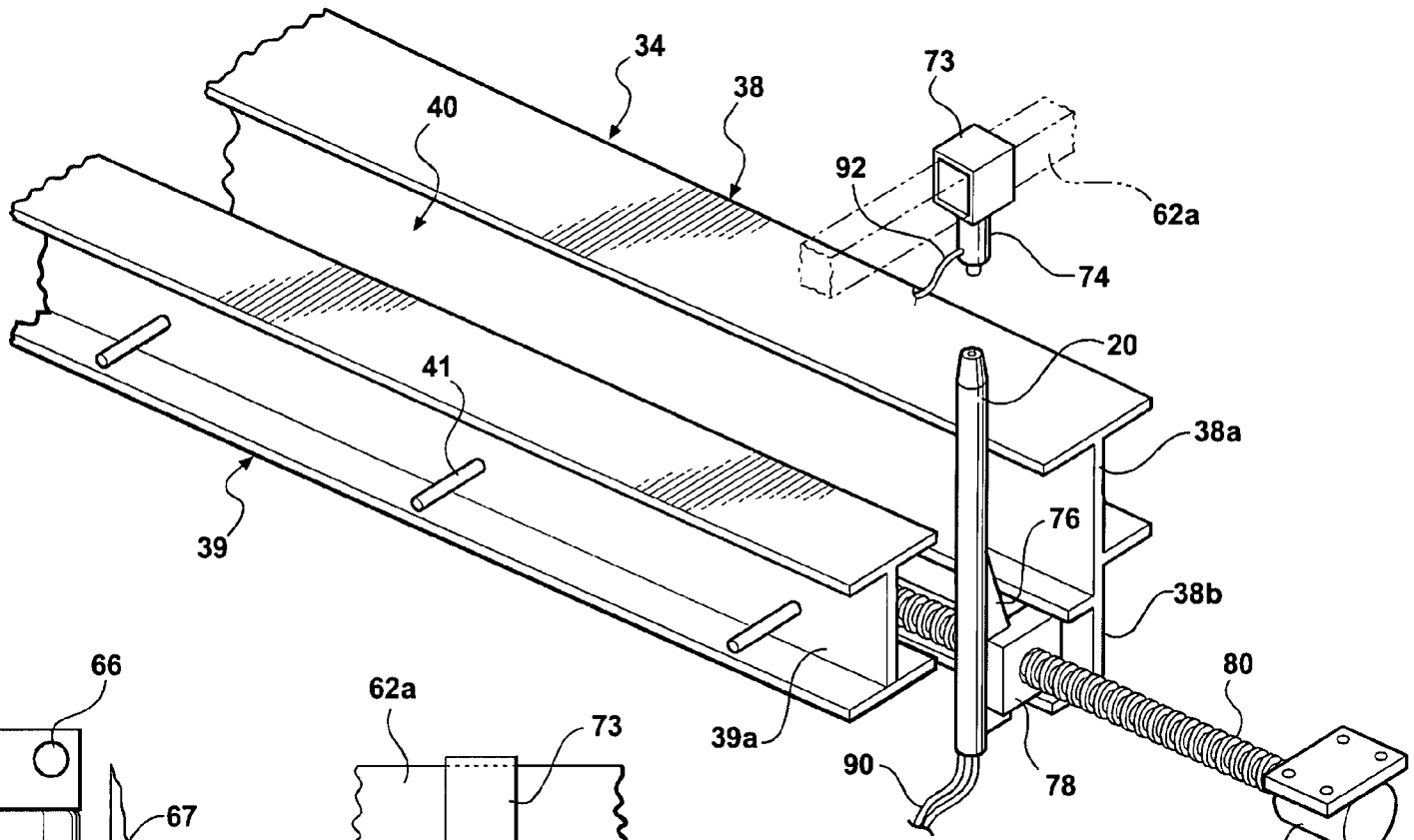
FIG. 7 is a perspective view of a beam structure utilized in the roller assembly.
Figure 11:
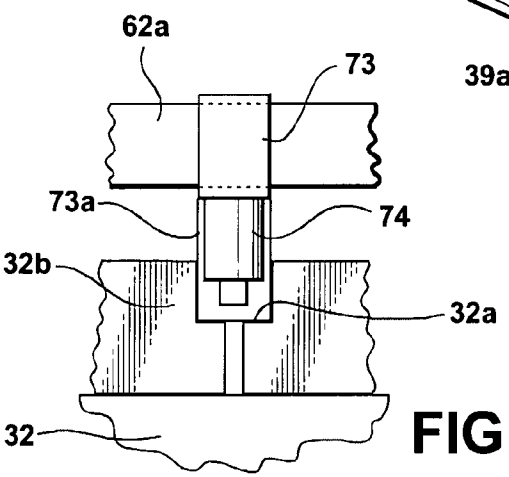
FIGS. 10, 11, and 12 are fragmentary, detail views of specific aspects of the handling apparatus.
Figure 10:
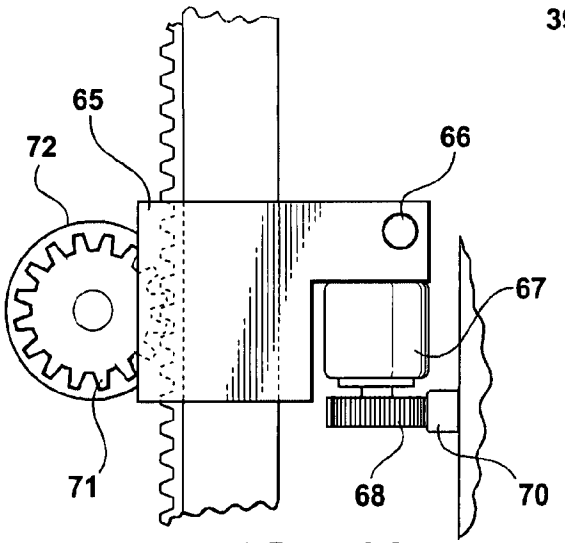
Figure 8:
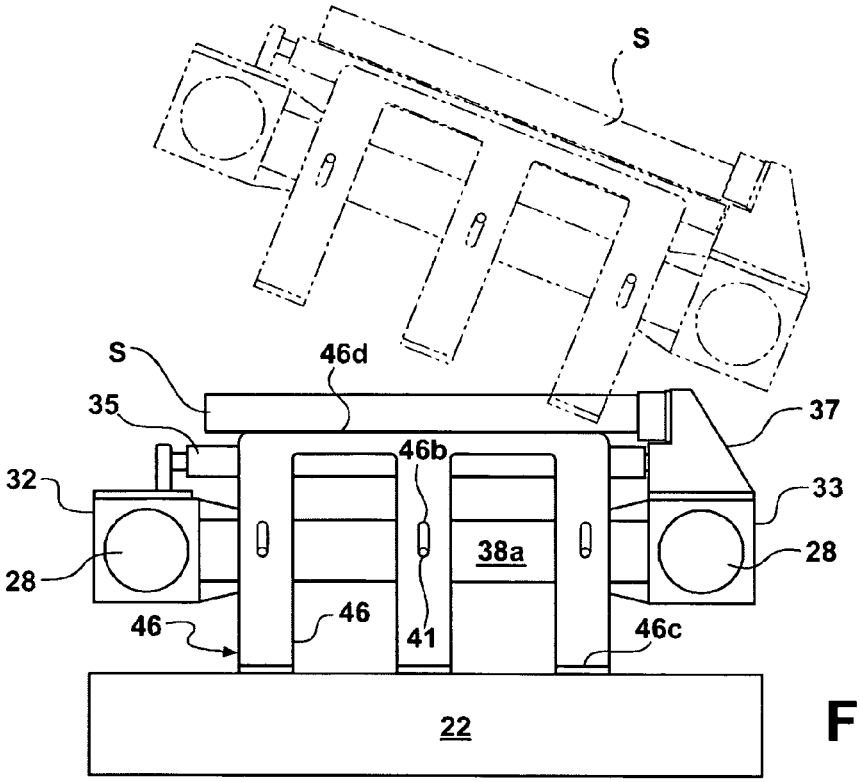
FIGS. 8 and 9 are schematic views illustrating the operation of the roller and buffer assembly.

With the handling apparatus in the horizontal or lowered position seen in FIGS. 1 and 2 and in solid lines in FIG. 8, and with the deburring gantry positioned in a lowered position essentially behind table assembly end plate 14*c*, a slab S is delivered to the upper face of the table utilizing, for example, an overhead crane employing a magnetic grabber. Previous to such delivery the various roller assemblies 30 have been selectively moved along the guide rails 28 (either manually or by suitable power means 42/43) to approximate the location of the various cross cuts or slits that are to be made in the slab. The deburring devices 64 are moved along with the roller assemblies to maintain each deburring device 74 in alignment between a respective pair of rollers 35 and thereby in vertical alignment with the torch carried by the respective roller assembly. The deburring devices may be moved manually and separately or, as seen in FIG. 11, an indexing finger 73*a* may be provided in association with each sleeve bracket 73 for engagement in a notch 32*a* provided in a bracket 32*b* carried by the upper face of each guide block 32 so that lateral movement of the roller assemblies along the guide rails 28 with the gantry in a lowered position has the effect of moving the deburring devices with the associated roller assemblies so that vertical alignment of each deburring device 74 with its respective torch 20 is always maintained.

Figure 9:
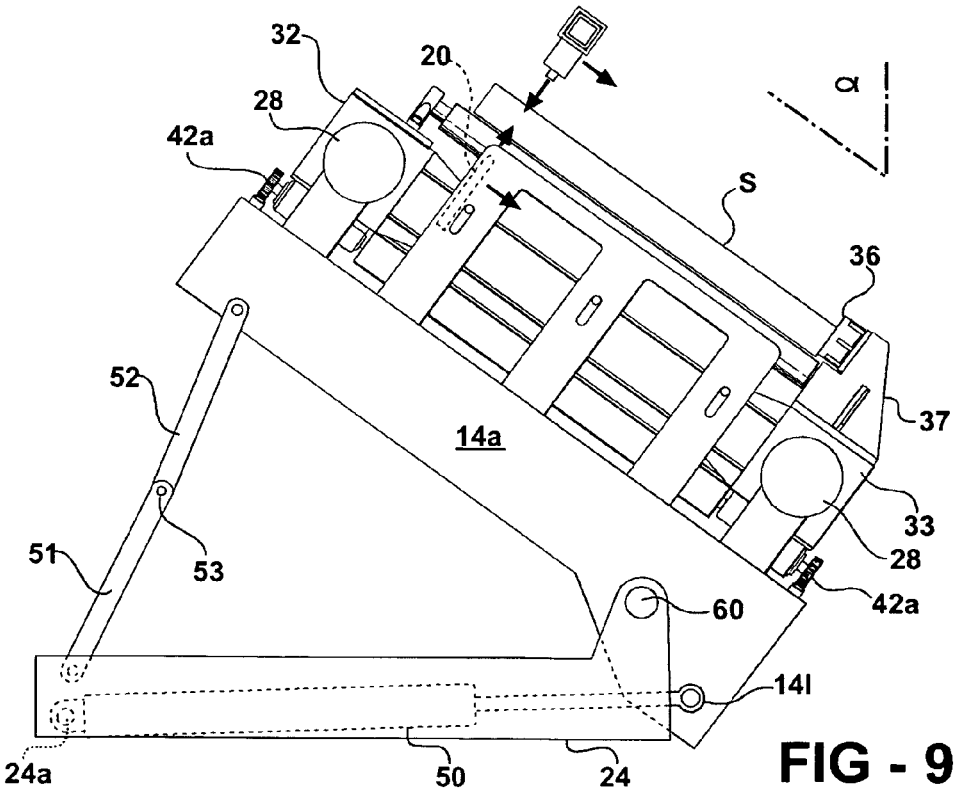
Figure 12:
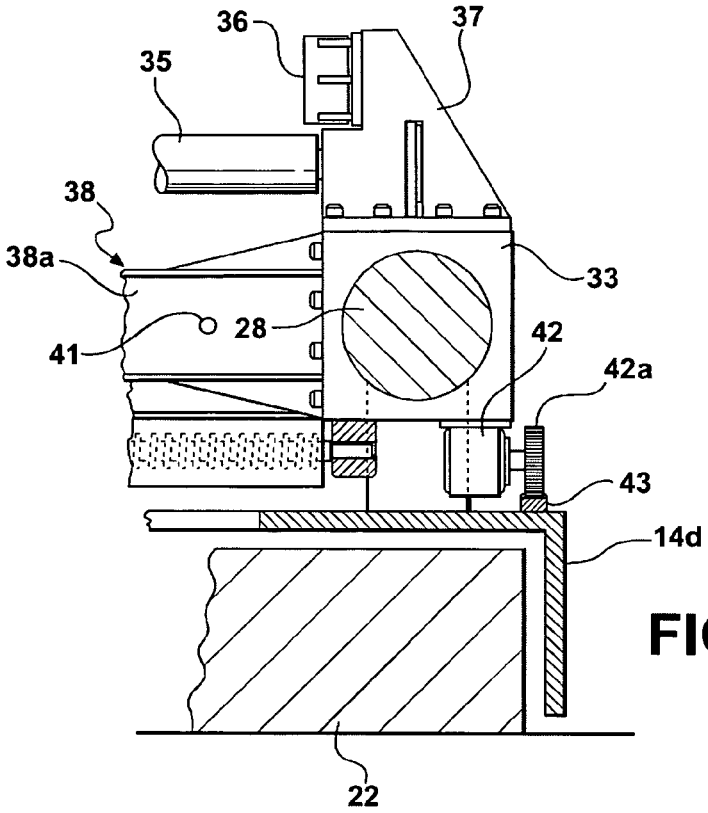
Figure 13:
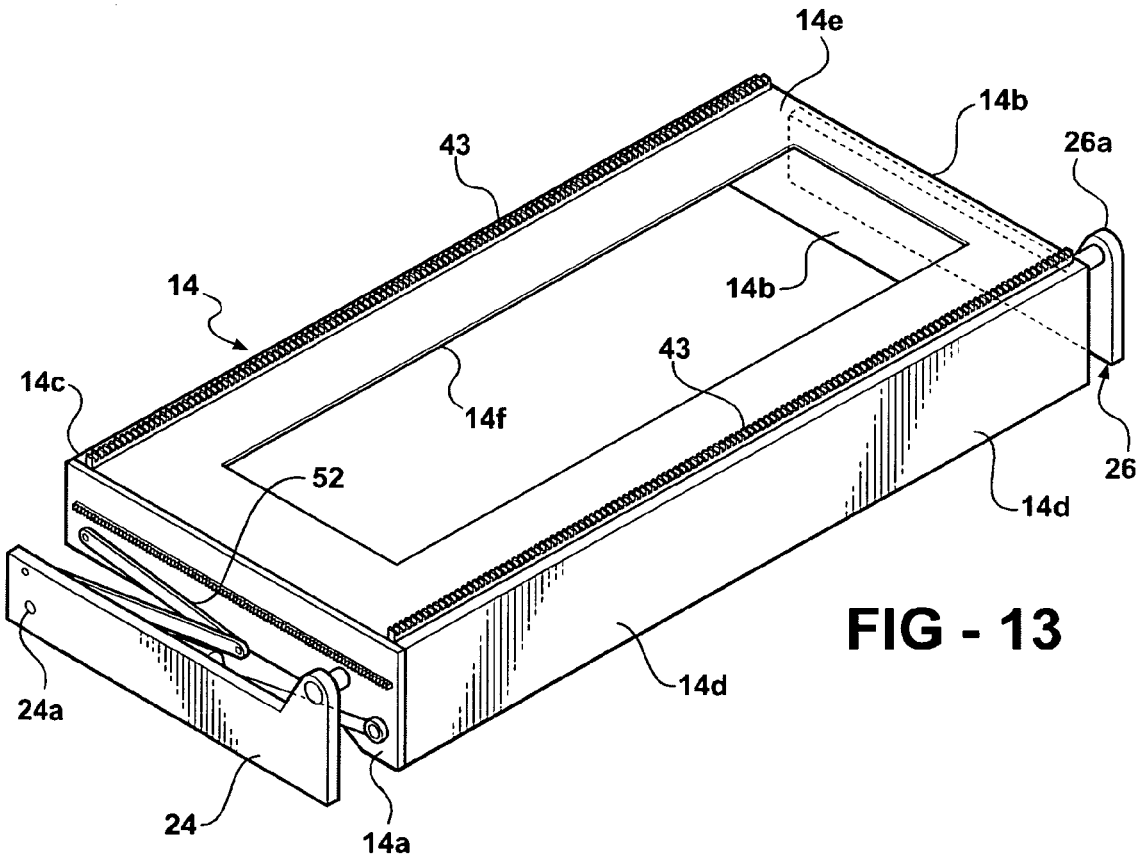
FIG. 13 is a schematic view of a portion of the handling apparatus.

With the table in the horizontal position and the base members of the buffer devices supported on the upper face of the foundation slab 22, the upper edges 46*d* of the side plates 46 of the buffer devices are positioned above the upper surfaces of the rollers 35 so that, as a slab S is lowered into position on the table, the slab engages the upper edges 46*d* of the buffer devices and there is no contact between the slab and the rollers 35 and therefore no opportunity for a heavy, dropping slab to damage the rollers. After the slab has been positioned on the upper edges 46*d* of the buffer assemblies, the rams 50 are contracted whereby to rotate the table about the axes of the pins 60. As the table rotates upwardly, and as schematically seen in the dash line position of FIG. 8, the base members of the buffer devices lift off from the foundation member and the buffer members move downwardly relative to the rollers 35 by virtue of the lost motion connection provided by the pins 41 and the elongated slots 46*b* so that the rollers move into engagement with the lower face of the slab and the rollers assume the full weight of the slab. This partially raised position is seen in dash lines in FIG. 8. In this partially raised position on the table, the position of the roller assemblies along the length of the slab may be fine tuned by vernier movement of the roller assemblies along the guide rails to effect the final precise locations of the cross cuts to be accomplished on the slab. This vernier adjustment of the roller assemblies is achieved by selective energization of motors 42 in coaction with racks 43. As the vernier adjustment of the roller assemblies is accomplished, and assuming the use of the indexing arrangement of FIG. 11, the deburring devices 74 undergo a corresponding vernier adjustment whereby to maintain their central location relative to a respective pair of rollers 35 whereafter the gantry is raised in the sleeves 64 to disengage the indexing fingers 73*a* from the notches 32*a*. The upward pivotal movement on the table is now resumed and the table is moved upwardly to its fully upwardly tilted position seen in FIG. 9.

At this time the respective deburring devices 74 and torches 20 are moved in synchronization downwardly along the slab between the respective roller pairs 35 to effect the several cross cuts of the slab with each torch 20 (utilizing for example oxygen and natural gas provided by conduits 90) coacting in known manner with a respective deburring device 74 (utilizing for example oxygen provided by a conduit 92) to achieve a clean kerf with minimal slag. The movement of the torches is achieved by energization of screw drive motors 82 and the synchronized movement of the deburring devices is achieved by energization of motors 67. Following the cutting operation the rams 50 are extended to pivot the table downwardly about the axes of pins 60 to the horizontal position. As the table arrives in the horizontal position, the foundation members 46*c* of the buffer devices 44 re-engage the upper face 22*a* of the foundation block to move the buffer devices upwardly relative to the associated rollers 35 by virtue of the lost motion connection provided by the pins 41 and the elongated slots 46*b* so that, as the table reaches the horizontal position, the slab is again supported on the upper edges 46*d* of the buffer devices whereafter the overhead crane and magnetic grabbers may again be employed to remove the cut slab sections from the table whereafter another slab may be loaded onto the upper edges of the buffer devices preparatory to a new slitting operation.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A slab handling apparatus comprising:

a foundation structure;

a plurality of longitudinally spaced buffer members positioned on the foundation structure; and a plurality of longitudinally spaced roller assemblies, each buffer member connected to a roller assembly with a lost motion connection allowing relative movement between the buffer member and the roller assembly between a slab loading position in which the buffer member is supported on the foundation structure with an upper edge thereof above the roller assembly, whereby to allow the loading of a slab onto the upper edges without damage to the roller assemblies, and a slab slitting position in which the roller assembly is above the upper edge of the buffer member, whereby to allow the roller assemblies to rollably support the slab to facilitate selective longitudinal adjustment of the slab to accommodate the slab slitting operation.

2. An apparatus according to claim 1 wherein each lost motion connection comprises a vertical slot receiving a pin, the pin moving vertically in the slot as the buffer member moves relative to the roller assembly between the loading and slitting positions.

3. An apparatus according to claim 2 wherein the pins are carried by the roller assemblies and the slots are provided in the buffer members.

4. An apparatus according to claim 1 wherein:

the apparatus further includes a table defining a window and mounted for pivotal movement between a generally horizontal slab loading position in which the slab window overlies the foundation structure and an upwardly tilted slab slitting position;

the roller assemblies are mounted in longitudinally spaced relation on the table and the buffer members are supported in longitudinally spaced relation on the table by the lost motion connections between the roller assemblies and the buffer members; and with the table in the horizontal slab loading position, the buffer members are positioned in the table window and are supported on the foundation structure.

5. A slab handling apparatus comprising:

a foundation structure;

a plurality of longitudinally spaced buffer members positioned on the foundation structure; and a plurality of longitudinally spaced roller assemblies connected to the buffer members with a lost motion connection allowing relative movement between the buffer members and the roller assemblies between a slab loading position in which the buffer members are supported on the foundation structure with upper edges thereof above the roller assemblies, whereby to allow the loading of a slab onto the upper edges without damage to the roller assemblies, and a slab slitting position in which the roller assemblies are above the upper edges of the buffer members, whereby to allow the roller assemblies to rollably support the slab to facilitate selective longitudinal adjustment of the slab to accommodate the slab slitting operation;

the apparatus further including a table defining a window and mounted for pivotal movement between a generally horizontal slab loading position in which the slab window overlies the foundation structure and an upwardly tilted slab slitting position;

the roller assemblies being mounted in longitudinally spaced relation on the table and the buffer members being supported in longitudinally spaced relation on the table by the lost motion connections between the roller assemblies and the buffer members;

with the table in the horizontal slab-loading position, the buffer members being positioned in the table window and being supported on the foundation structure;

each lost motion connection comprising a vertical slot receiving a pin; and the pins being spaced from the top end of the slots with the apparatus in the slab loading position and moving upwardly in the slots as the table is pivoted upwardly until the pins engage the top end of the slots whereafter, with continued upwardly pivotal movement of the table, the buffer members move upwardly with the roller assemblies.

6. A slab handling apparatus according to claim 5 wherein:

the roller assemblies are mounted on the table for longitudinal sliding movement; and the buffer members move longitudinally with the roller assemblies by virtue of the lost motion connections therebetween.

7. A slab handling apparatus according to claim 6 wherein:

the table includes a pair of parallel longitudinally extending guide rails; and each roller assembly includes a pair of laterally spaced guide blocks slidably guided on the respective guide rails, a beam structure extending laterally between the guide blocks, and a roller structure extending laterally between the guide blocks in overlying relation to the beam structure and journaled at opposite ends thereof on the respective guide blocks.

8. A slab handling apparatus according to claim 7 wherein:

each buffer member comprises an upstanding plate supported on the foundation structure with the apparatus in the slab loading position; and each lost motion connection comprises a plurality of laterally spaced pins projecting from a beam structure of a roller assembly and received in a respective plurality of vertical slots provided in a buffer member plate.

9. A slab handling apparatus according to claim 7 wherein:

each buffer member comprises forward and rearward longitudinally spaced and coupled upstanding plates flanking a respective roller assembly; and each lost motion connection comprises a plurality of laterally spaced pins projecting forwardly and rearwardly from the beam structure of the respective roller assembly and received in a respective plurality of vertical slots in the forward and rearward plates of the buffer member.

10. A slab handling apparatus according to claim 7 wherein:

each roller structure comprises a pair of longitudinally spaced rollers journaled at opposite ends on the guide blocks; and each roller assembly further includes an upwardly directed torch positioned between the longitudinally spaced rollers and means operative to move the torch laterally between the rollers to achieve the slitting operation.

11. A slab handling apparatus according to claim 10 wherein:

the beam structure of each roller assembly comprises a pair of laterally extending and longitudinally spaced beams; and each torch extends upwardly between a pair of beams and between a pair of rollers of the respective roller assembly.

12. A slab handling apparatus according to claim 10 wherein the apparatus further includes a deburring device positioned in opposition to each torch and moveable laterally with the torch to achieve the slitting operation.

13. A slab handling apparatus according to claim 12 wherein:

the apparatus further includes a gantry mounted on the table and including a central bar portion extending longitudinally of the table; and the deburring devices are slidably mounted on the gantry central bar portion in longitudinally spaced relation.

14. A slab handling apparatus according to claim 13 wherein the apparatus further includes means for moving the gantry laterally relative to the table whereby to allow the deburring devices to be moved to a location clear of the rollers to allow the loading of a slab onto the rollers and thereafter moved laterally in synchronization with the associated torches to accomplish the slitting operations.

15. A slab handling apparatus according to claim 14 wherein the apparatus further includes means for raising and lowering the gantry relative to the table.

16. A slab handling apparatus comprising:

a foundation structure;

a table defining a window and mounted for pivotal movement between a generally horizontal slab loading position in which the slab window overlies the foundation structure and an upwardly tilted slab slitting position;

a plurality of roller assemblies spaced longitudinally on the table and extending laterally across the table and across the window; and a plurality of buffer members each connected to a roller assembly with a lost motion connection allowing relative movement between the buffer member and the roller assembly between a slab loading position in which the buffer member is supported on the foundation structure within the window with upper edge of the buffer member above the roller assembly and a slab slitting position in which the roller assembly is above the upper edge of the buffer member, the movement of the roller assemblies and buffer members from the slab loading position to the slab slitting position occurring in response to upward pivotal movement of the table from the horizontal slab loading position to the upwardly tilted slab slitting position.

17. A slab handling apparatus according to claim 16 wherein:

each buffer member comprises a laterally extending upstanding plate supported at a lower edge thereof on the foundation structure with the apparatus in the slab loading position;

each roller assembly includes a laterally extending beam structure; and the lost motion connection between the roller assembly and the buffer member comprises pins mounted in vertical slots.

18. A slab handling apparatus according to claim 17 wherein the pins are carried by a beam structure and are received in vertical slots in the respective buffer member plate.

19. A slab handling apparatus according to claim 16 wherein:

the table includes a pair of parallel longitudinally extending guide rails on opposite sides of the window; and each roller assembly includes a pair of laterally spaced guide blocks slidably guided on the respective guide rails, a pair of longitudinally spaced beams extending laterally between the guide blocks, a pair of longitudinally spaced rollers extending laterally between the guide blocks in overlying relation to the beams, and a torch extending upwardly between the beams and between the rollers for application of a cutting flame to the underside of a slab positioned on the rollers.

20. A slab handling apparatus according to claim 19 wherein each roller assembly further includes means operative to move the torch laterally between the rollers and the beams to perform a slitting operation on a slab positioned on the rollers.

21. A slab handling apparatus comprising a plurality of longitudinally spaced slab handling assemblies arranged to collectively receive a slab, characterized in that:

each slab handling assembly comprises a buffer member having a lower edge positionable on a support surface and an upper edge, and a roller assembly connected to the buffer member with a lost motion connection operative to allow relative movement between the buffer member and the roller assembly between a slab loading position in which the lower edge of the buffer member is supported on the support surface with the upper edge thereof above the roller assembly, whereby to allow the loading of a slab onto the upper edges of the buffer members without damage to the roller assemblies, and a slab slitting position in which the roller assembly is above the upper edge of the buffer member, whereby to allow the roller assemblies to rollably support the slab to consolidate selective longitudinal adjustment of the slab to accommodate the slab slitting operation.

* * * * *